US005366129A

United States Patent [19]

Nakamura et al.

[11] Patent Number: 5,366,129

[45] Date of Patent: Nov. 22, 1994

[54] TAPE CUTTER

[75] Inventors: Shinsuke Nakamura; Satoshi Mochizuki; Naoki Hariu, all of Tokyo, Japan

[73] Assignee: Midori Co., Ltd., Tokyo, Japan

[21] Appl. No.: 993,042

[22] Filed: Dec. 18, 1992

[51] Int. Cl.[5] ..... B65D 85/672; B26F 3/02

[52] U.S. Cl. ..... 225/42; 225/47; 225/77; 248/205.8

[58] Field of Search ..... 225/42, 46, 47, 77; 248/205.8, 205.9, 362, 186, 425

[56] References Cited

U.S. PATENT DOCUMENTS

| | | | |
|---|---|---|---|
| 3,082,988 | 3/1963 | Holden | 248/205.8 |
| 3,240,461 | 3/1966 | Singleton | 248/205.8 |
| 3,489,324 | 1/1970 | Stohl | 225/42 |
| 3,681,175 | 8/1972 | Cote | 225/42 |
| 5,031,865 | 7/1991 | Blattner | 248/205.8 |

*Primary Examiner*—Hien H. Phan

*Attorney, Agent, or Firm*—Wenderoth, Lind & Ponack

[57] ABSTRACT

A tape dispenser has a housing in which a roll of adhesive tape is rotatably supported, a cutter provided on the front of the housing for cutting the adhesive tape to desired lengths, an adhering member for adhering the tape dispenser to a supporting surface, and both a support rod rotatably mounted to the housing, and a ring-shaped support disposed at an end of the support rod and rotatably supported by the adhering member. Thus, with the adhering member adhering the tape dispenser to a supporting surface, the housing of the tape dispenser can be rotated about the support rod so as to be movable between vertical and horizontal orientations. Also, the housing can be rotated 360° about the adhering member such that the cutter of the tape dispenser can be moved to a desired angular position while the tape dispenser remains adhered to the supporting surface. When the adhering member is a suction pad, a position adjusting mechanism is employed to place the suction pad in a suction state or a non-suction state.

7 Claims, 5 Drawing Sheets

TAPE CUTTER

BACKGROUND OF THE INVENTION

1. Field of the Invention

This invention relates to a tape dispenser which can be freely turned after being suction-attached to an object such as the top of a desk and the side of a piece of OA equipment, and in particular to a tape cutter having a housing that can be rotated 360 degrees with respect to the suction surface of a suction component thereof and which can be turned through 360 degrees above the suction surface.

2. Prior Art

Conventionally, tape dispensers incorporate suction pads on the bottom of vertically oriented casings thereof.

Also, there are tape dispensers which, in place of a suction pad mounted to the bottom surface of the casing, incorporate a heavy weight in the bottom portion of the casing to prevent it from being inverted.

However, the conventional tape cutters which have suction pads mounted to the bottom surface of the casings thereof cannot be oriented as desired with respect to the suction pad. Thus, the tape cutter of the tape dispenser attached to an object under suction cannot be oriented as desired, e.g. the tape dispenser cannot be positioned for use horizontally with respect to the suction pad.

On the other hand, because the conventional tape dispenser which incorporates a heavy weight in the bottom portion of the casing is extremely heavy, it cannot be carried around easily, and can cause an injury if it is dropped on one's foot.

SUMMARY OF THE INVENTION

The present invention has been developed in consideration of the above-discussed drawbacks of the prior art. It is an object of the invention to provide a tape dispenser which is lightweight and which, when suction-attached to a supporting surface, can be turned through 360 degrees about the suction surface of the dispenser which creates the suction, resulting in that the cutting edge of the tape cutter can be oriented as desired, and which can also be turned through 360 degrees with respect to the suction surface, resulting in that the vertical tape dispenser can be positioned horizontally for use.

To achieve this object, the tape dispenser of this invention includes:

a housing which has side plates one of which is removable;

a roll of adhesive tape rotatably supported by a cylindrical member protruding from the inside of the other side plate of the housing;

a cutter provided on a front plate of the housing;

a ring-shaped support which is rotatably mounted to the housing by means of a support rod, which rod protrudes from the housing into a recess in the lower corner of the housing; and a suction component which is rotatably mounted within said ring-shaped support and has a suction surface disposed at the lower end of the ring-shaped support 10. Alternatively, a magnet could be used as a means to adhere the tape dispenser to a support surface. In addition, a position adjusting mechanism supports the suction component within the ring-shaped support. The ring-shaped support can be rotated 360 degrees around the mechanism. The mechanism allows the position of the suction surface of the suction component to be changed from a suction to a non-suction position or vice versa when a knob of the mechanism is turned.

DETAILED DESCRIPTION OF THE INVENTION

Figure 1:
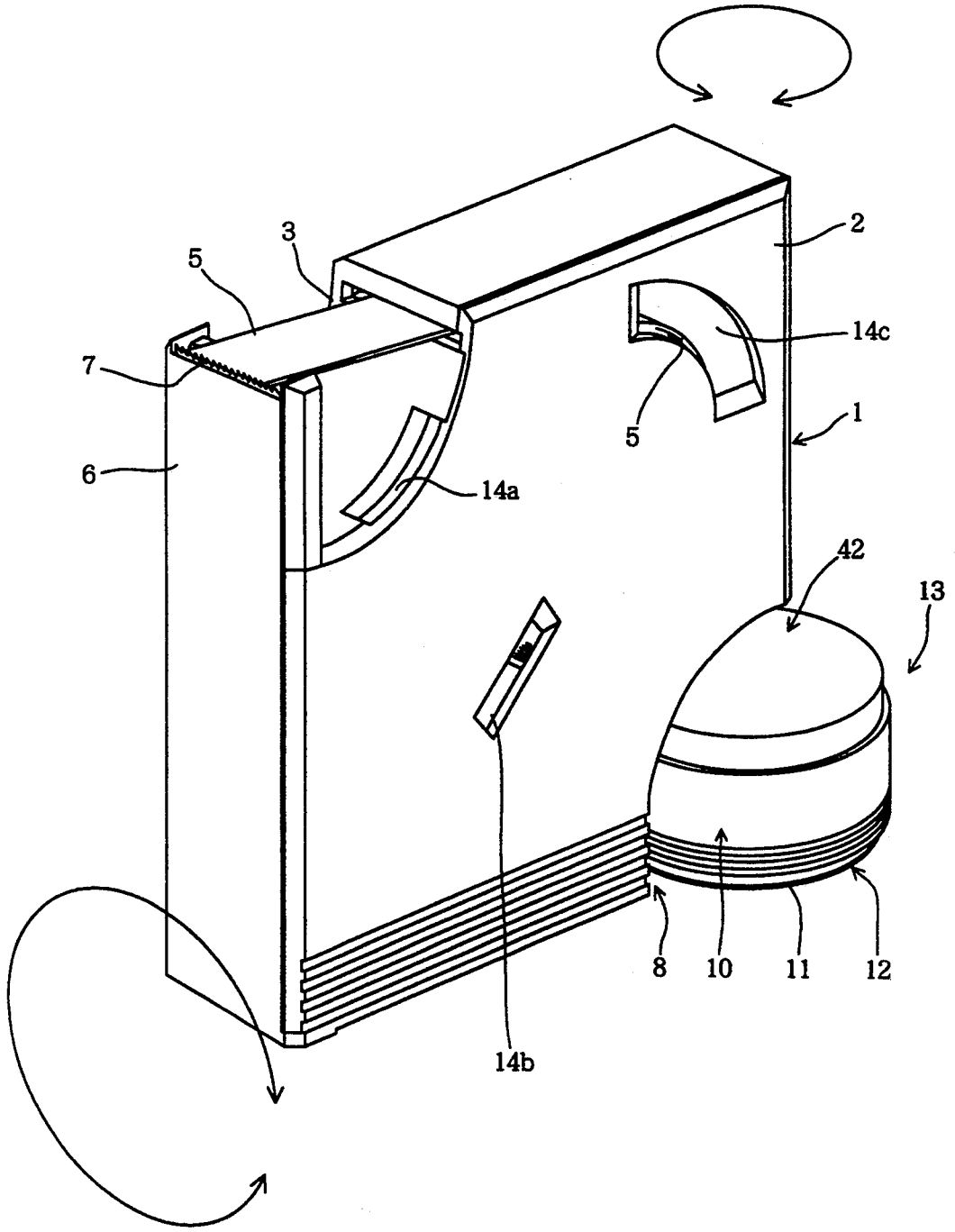
FIG. 1 is a perspective view of an embodiment of a tape dispenser according to the present invention.
Figure 2:
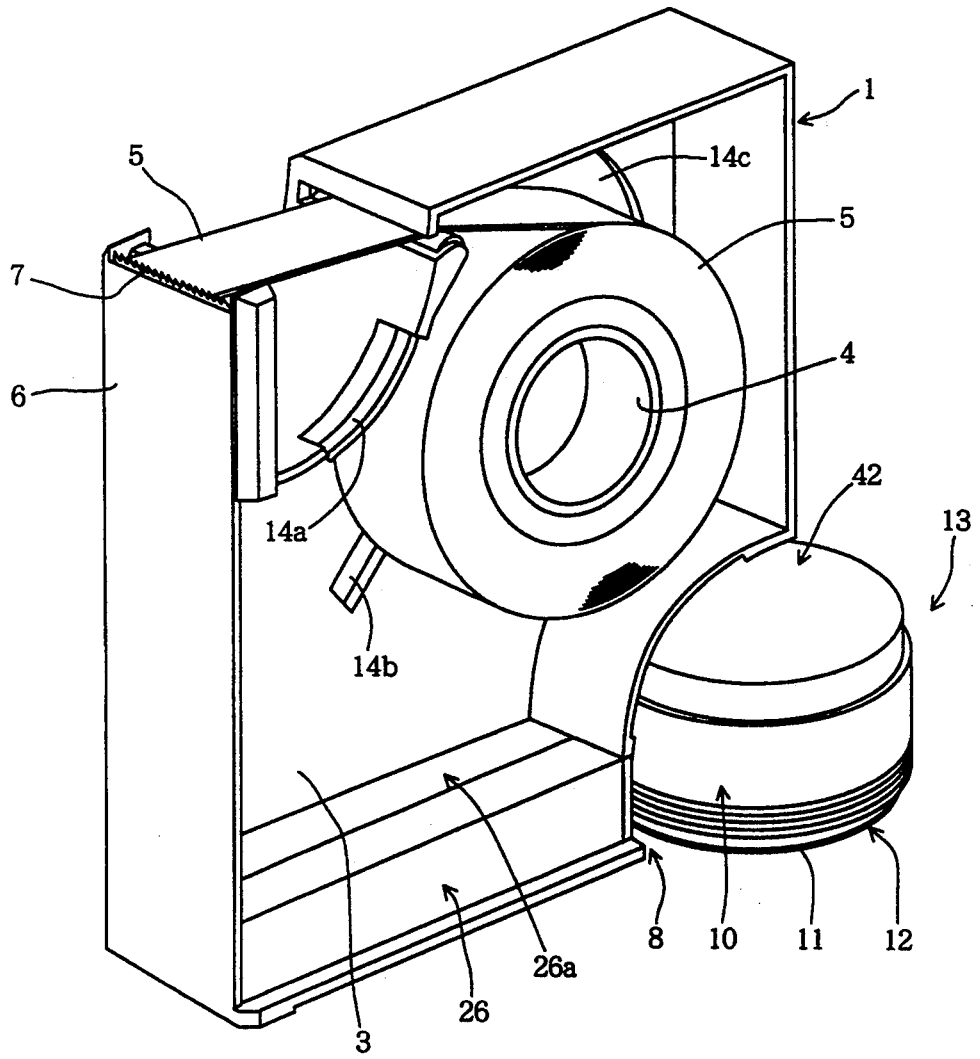
FIG. 2 is a perspective view of the same tape dispenser whose side plate is removed from the housing.

As shown in FIGS. 1 to 5, the tape dispenser of the present invention includes a housing 1 in the form of a thin, flat case of a material such as a plastic. The housing includes side plates 2 and 3, and one of the side plates, e.g. the side plate 2, is removable.

A roll of adhesive tape 5 is rotatably supported on a cylindrical member 4 protruding from the inside of the (non-removable) side plate 3 of the housing 1.

A cutter 7 is provided on a front plate 6 of the housing 1.

A ring support 10 is rotatably mounted to the housing 1 by means of a support rod 9 within a recess 8 in the lower rear corner of the housing 1. The ring support 10 allows the housing 1 to be rotated 360° as shown by the arrow in FIG. 1 (the arrow shown under the left side of the housing 1).

A suction pad 21 made of an elastic material and serving as a suction component 12 has suction surface 11 at the bottom of the ring support 10. The suction component 12 includes a shaft 20 extending vertically from the central portion of the pad 21 as shown in FIG. 3.

A position adjusting mechanism 13 allows the housing 1 together with the ring support 10 to be rotated 360° relative to the suction surface as shown by the arrow in FIG. 1 (the arrow shown above the right side of the housing 1), and causes the state of the suction component 12 to change from a suction to a non-suction state or vice versa with respect to a suction object (such as the top of a desk or the side of a piece of OA equipment) when turned.

Figure 3:
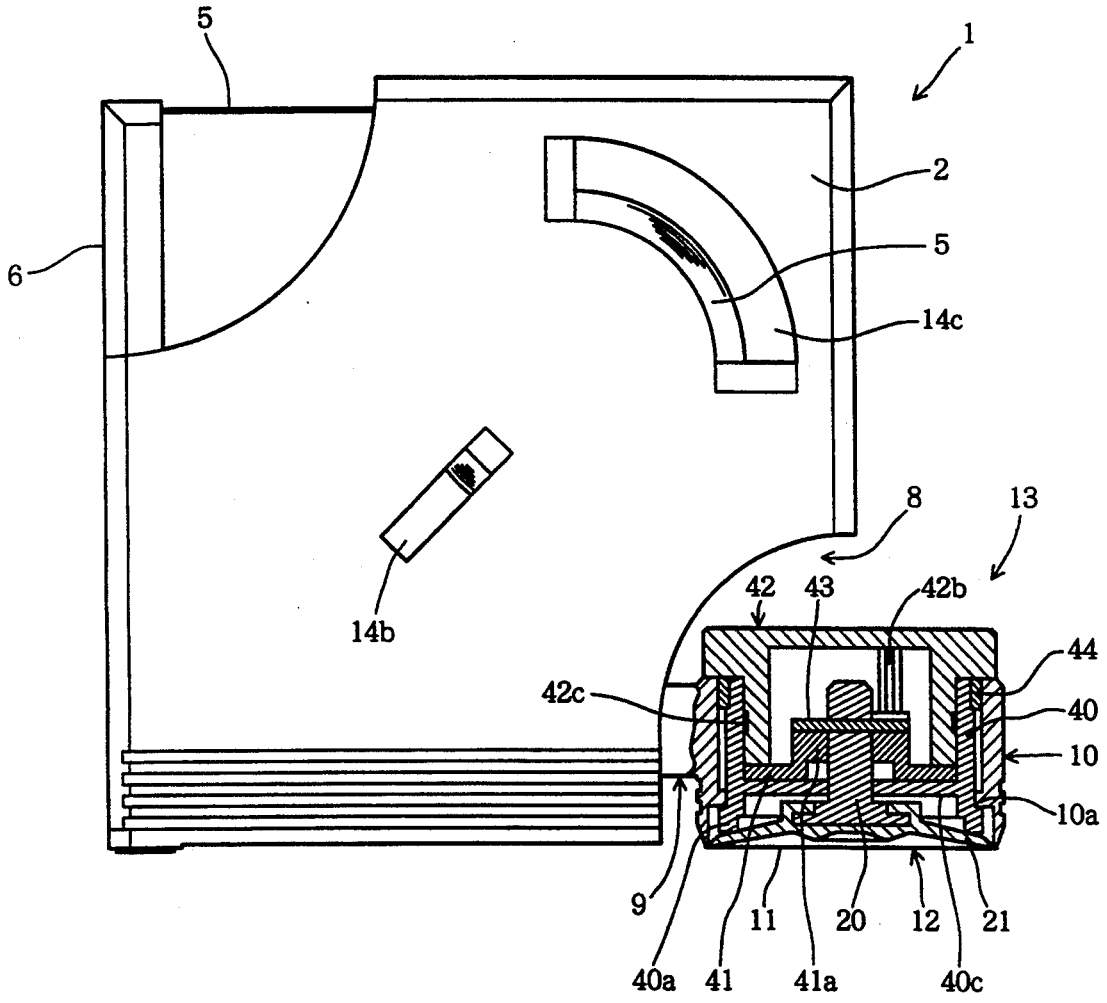
FIG. 3 is a side view of the tape dispenser, partially in section, showing the state in which an adjusting mechanism places the suction pad in a suction position.
Figure 4:
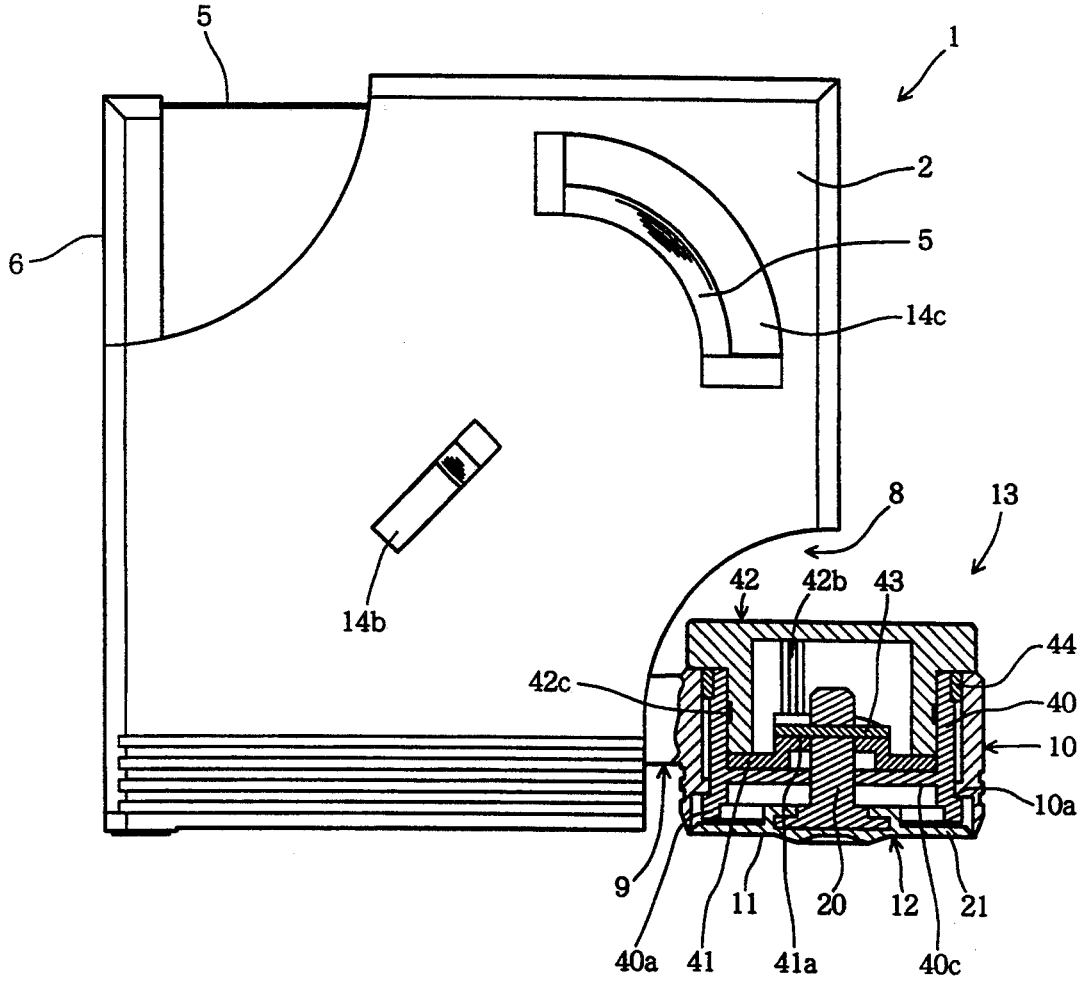
FIG. 4 is a view similar to that of FIG. 3 but showing a state in which the adjusting mechanism places the suction pad in a non-suction position.
Figure 5:
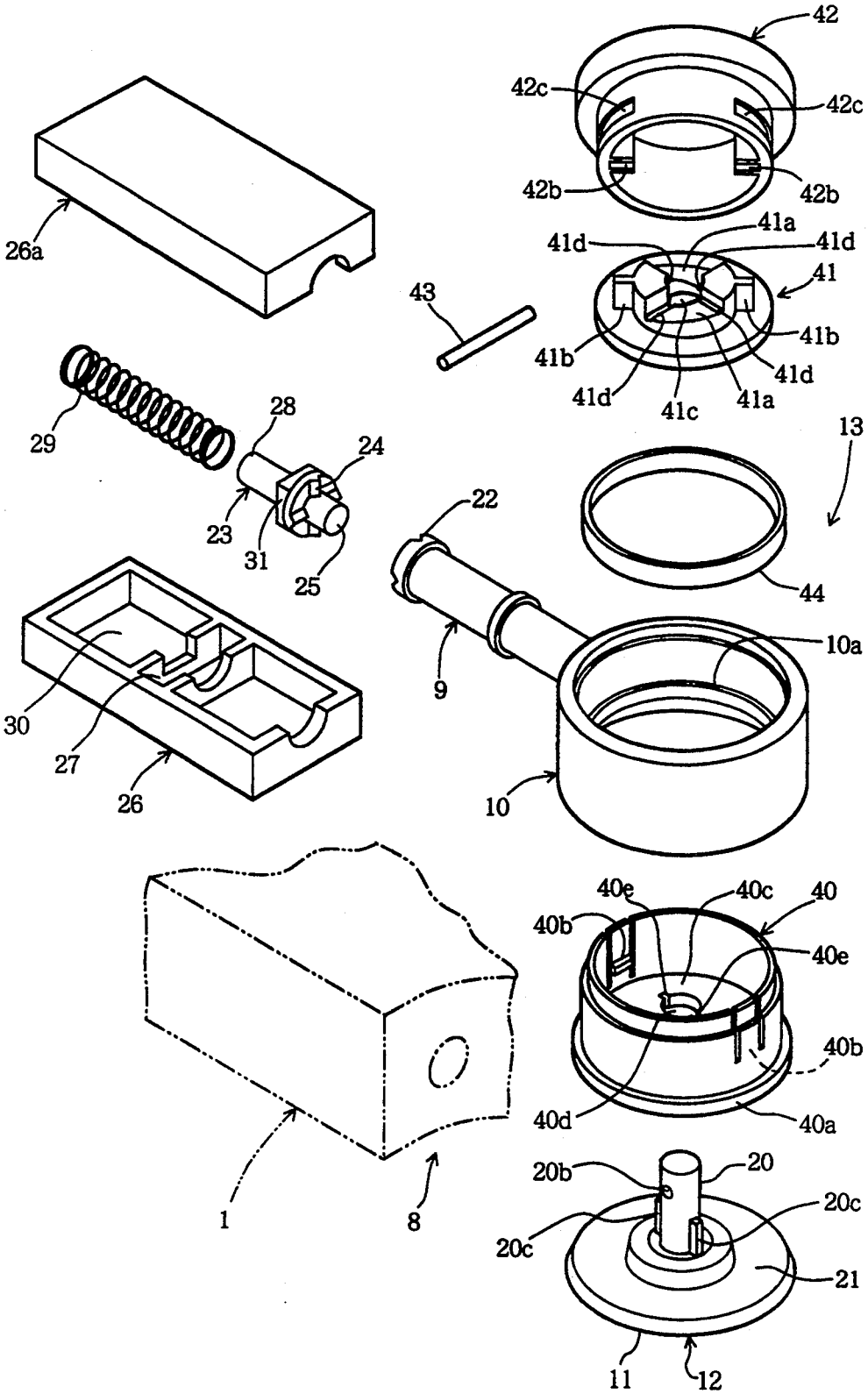
FIG. 5 is an exploded view of the position adjusting mechanism.

As shown in FIGS. 3, 4 and 5, the bottom of the housing houses one end of the support rod 9 which projects from inside the housing into the recess 8 in the lower corner of the housing 1 to connect the housing 1 with the ring support 10 so that the housing and ring support can be rotated relative to each other. The other end of the support rod 9 is fixed to the outer periphery of the ring support 10 or is molded with the ring support 10.

The end of the support rod 9 that is housed in the bottom of the housing 1 is provided with four concavities 22 which are to receive convex portion 24 formed on a shaft 23. The support rod 9 is hollow, and an end portion 25 of the shaft 23 is received in the bore of shaft 9. The concavities 22 of the support rod 9 and the convex portions 24 of the shaft 23 are fitted to each other within a space 27 defined by a casing 26 incorporated in the bottom of the housing 1. The round end portion 28 of the shaft 23 receives a spring 29 which urges the shaft 23 against the support rod 9. The spring 29 is accommodated in a space 30 of the casing 26. A square stopper portion 31 disposed to the rear of the convex portions 24 prevents the shaft 23 itself from rotating in the casing 26.

Therefore, the housing 1 can be turned through 360 degrees with respect to the suction surface 11 of the suction component 12 as shown by the arrow in FIG. 1 (the arrow shown under the left side of the housing 1).

A covering 26*a*, having the same spaces and partitions as those formed in the casing 26, is fitted to the casing 26 from above to securely hold the spring 29, shaft 23, and the end of the support rod 9 in the casing 26.

Reference numeral 14*a* in the figures denotes a groove which accommodates one's fingertip to facilitate the removal of the side plate 2 of the housing 1, while 14*b* and 14*c* designate windows which allow the amount of adhesive tape 5 consumed to be determined from outside of the housing 1.

The position adjusting mechanism 13 includes a base 40, a cam 41, an operation knob 42, a constraining pin 43, and a packing ring 44. The base 40 is approximately cylindrical and has a concave bottom 40*c*, two engaging protrusions 40*b* diametrically opposite one another on the inner lower portion of the periphery of the base, and a hole 40*d* in the bottom 40*c* thereof and which hole 40*d* receives the shaft 20 of the suction pad 21. The cam 41 is rotatably supported on the bottom of the cylindrical base 40 and has diametrically opposed cam portions 41*a* and fitting protrusions 41*b* on the top thereof.

The operation knob 42 is received in the top of the cylindrical base 40 so as to be disposed above the cam 41. The knob 42, which is generally cylindrical, has a pair of fitting recesses 42*b* which receive the fitting protrusions 41*b* of the cam 41, and a pair of elongate grooves 42*c* receiving the engaging protrusions 40*b* of the cylindrical base 40.

The constraining pin 43 holds the cam 41 on the bottom 40*c* of the base 40. The pin 43 extends through a horizontal hole 20*b* in the shaft 20 protruding above the through-hole 41*c* in the cam 41.

The packing 44 is interposed between the inner periphery of the ring support 10 and the cylindrical base 40.

The elongate grooves 42*c* in the operation knob 42 are of a length sufficient to allow the operation knob 42 and the cam 41 to be turned through 90 degrees in either a clockwise or counterclockwise direction.

As noted above, the engaging protrusions 40*b* of the cylindrical base 40 are received in the elongate grooves 42*c* in the operation knob 42. The flange 40*a* at the lower end of the cylindrical base 40 is fitted to the ring support 10 in contact with the lower side of an annular protrusion 10*a* provided at the inner periphery of the ring support 10. Therefore, the ring support 10 can be turned through 360 degrees around the cylindrical base 40 without being separated from the cylindrical base 40.

Small protrusions 20*c* are provided on the outer periphery of the shaft 20 of the suction pad 21, while the hole 40*d* in the cylindrical base 40 includes slots 40*e* having a geometry complementary to that of the small protrusions 20*c*. Thus, the suction pad 21 is not allowed to slip relative to the cylindrical base 40 in the rotary direction.

Because the fitting protrusions 41*b* of the cam 41 are received in the pair of fitting recesses 42*b* of the operation knob 42, an external operation force (i.e., a turning force) applied to the operation knob 42 is transmitted to the cam 41.

The cam surfaces of the cam portions 41*a* of the cam 41 are provided with straight, small recesses 41*d* whose central axes intersect at right angles at the center of the through-hole 41*c*, and the small recesses 41*d* accommodate the constraining pin 43. In addition, as previously stated, the operation knob 42 and the cam 41 fitted to it can be turned through 90 degrees either clockwise or counterclockwise. Therefore, when the operation knob 42 is turned, the cam 41 is turned, thereby displacing the constraining pin 43 along the cam surfaces 41*a* from a highest location to a lowest one or vice versa.

Specifically, when the constraining pin 43 is positioned in the small recesses 41*d* at the lowest portion of the cam surfaces of the cam portions 41*a*, the shaft 20 of the suction pad 21 is positioned in the extreme downward position, as shown in FIG. 4, with the central portion of the bottom surface of the suction pad 21 being positioned also in the extreme downward position. Therefore, the suction pad 21 is in the non-suction state. On the other hand, when the operation knob 42 is turned to bring the constraining pin 43 out of the small recesses 41*d* at the lowest portion of the cam surfaces of the cam portions 41*a* to those in the highest portion of the cam surfaces, the shaft 20 of the suction pad 21 is also raised to the extreme upward position as shown in FIG. 3, resulting in that the suction pad 21 is in the suction state. Thus, the suction pad 21 can be easily released from the suction-permitting or suction state by simply turning the operation knob 42.

Therefore, in the present invention, turning the operation knob 42 will also turn the cam 41 within the cylindrical base 40. However, when the suction pad 21 is in the suction state shown in FIG. 3, the cylindrical base 40 and the suction pad 21 will not be turned.

The operation of the tape dispenser will now be described.

When the suction pad 21 of the tape dispenser is in the position shown in FIG. 3, and the suction pad 21 sticks to an object, the ring support 10 is also held in position through the shaft 20 and the cylindrical base 40, and the ring support 10 can be turned through 360 degrees around the cylindrical base 40 as shown by the arrow in FIG. 1 (the arrow shown above the right side of the housing 1). Thus, the housing 1, which is connected to the ring support 10, can also be turned with the ring support 10. Therefore, the cutter 7 of the tape dispenser suctioned to an object can be easily oriented as desired for convenient use.

The housing 1 is rotatably connected to the ring support 10 in a state in which the convex portions 24 of the shaft 23 are firmly fitted to the support rod 9 within concavities 22 and pressed thereagainst by the spring 29. Thus, the housing 1 can be turned through 360 degrees with respect to the suction surface 11 of the suction component 12 provided at the lower end of the ring support 10, as shown by the arrow in FIG. 1 (the arrow shown under the left side of the housing 1). Therefore, when the suction pad 21 is in the suction state the housing 1 can be positioned horizontally with respect to the suction surface 11, as might be required by the user, although the housing 1 is normally used in the vertical position with respect to the suction component 12.

Thus, this invention provides a tape dispenser having a unique turning and rotating capability.

To separate the tape dispenser from the suction object (release it from the suction state), the operation knob 42 in the state shown in FIG. 3 is turned 90 degrees in a counterclockwise direction, which results in the cam 41 being turned 90 degrees together with the operation knob 42. The constraining pin 43 is thus displaced into the small recesses 41*d* in the lowest portion of the cam surfaces of the cam portions 41*a* and the shaft 20 of the suction pad 21 is lowered to the extreme downward position shown in FIG. 4. The central portion of the bottom of the suction pad 21 in contact with the surface of the suction object relieves the vacuum in the space defined under the pad 21 by allowing air to be introduced into the space, whereby the tape dispenser can be easily removed from the suction object.

As shown in FIG. 1, with this tape dispenser, the adhesive tape 5 can, of course, be drawn out, and cut to a desired length by the cutter 7 provided on the front plate 6 of the housing 1. The roll of adhesive tape 5 in the housing 1 can be replaced by removing the side plate 2 from the housing 1.

In addition, this tape dispenser does not require any weight for preventing its inversion. Therefore, it can be extremely lightweight.

In addition, various changes and modifications, within the scope of the claims, will become apparent to those of ordinary skill in the art.

For example, a magnet, as an adhering means, can be substituted for the suction pad 21 in the above-described embodiment. Thus, all such changes and modifications are seen to be within the true spirit and scope of the invention.

What is claimed is:

1. A tape dispenser comprising:

a housing including side plates and a front plate, one of said side plates being removable from the remainder of the housing;

a cylindrical member for rotatably supporting a roll of adhesive tape, protruding into said housing from an inner surface of the other of said side plates;

a cutter provided on said front plate of housing;

a support rod rotatably mounted to said housing such that said housing can rotate about a longitudinal axis of said support rod;

a ring-shaped support disposed at an end of said support rod and integral therewith; and adhering means for adhering the tape dispenser to a supporting surface, said adhering means being supported within said ring-shaped support, and said ring-shaped support being rotatable relative to said adhering means such that when said adhering means is adhered to a supporting surface, the casing of the tape dispenser and said support rod integral with said ring-shaped support can be rotated about said adhering means.

2. A tape dispenser as claimed in claim 1, wherein said adhering means comprises a suction pad having a suction surface at which suction can be created to adhere the tape dispenser to a supporting surface, said suction surface being located at a lower axial end of said ring-shaped support.

3. A tape dispenser as claimed in claim 2, and further comprising a position adjusting mechanism mounting said suction pad to said ring-shaped support, said ring-shaped support being rotatable relative to said position adjusting mechanism, and said position adjusting mechanism being operable to selectively place said suction pad in a suction state in which suction is produced between the suction surface of said pad and a flat supporting surface and a non-suction state in which the suction produced between said suction surface and the flat supporting surface will be relieved.

4. A tape dispenser as claimed in claim 3, wherein said position adjusting mechanism includes a rotatable knob which is turnable relative to said ring-shaped support to selectively place said suction pad in said suction and non-suction positions.

5. A tape dispenser as claimed in claim 2, wherein said housing defines a recess at a rear lower portion thereof, and said support rod protrudes from said casing into said recess.

6. A tape dispenser as claimed in claim 3, wherein said housing defines a recess at a rear lower portion thereof, and said support rod protrudes from said casing into said recess.

7. A tape dispenser as claimed in claim 4, wherein said housing defines a recess at a rear lower portion thereof, and said support rod protrudes from said casing into said recess.

* * * * *